US006715240B2

(12) United States Patent
Beck et al.

(10) Patent No.: US 6,715,240 B2
(45) **Date of Patent: *Apr. 6, 2004**

(54) BUILDING PANEL AS A COVERING FOR BUILDING SURFACES AND METHOD OF APPLYING

(75) Inventors: David H. Beck, Jackson, MI (US); Robert W. Werner, Clawson, MI (US); Barbara E. Dennis, Wayne, PA (US)

(73) Assignee: CertainTeed Corporation, Valley Forge, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/386,607

(22) Filed: Mar. 12, 2003

(65) Prior Publication Data

US 2003/0154664 A1 Aug. 21, 2003

Related U.S. Application Data

(63) Continuation of application No. 09/438,999, filed on Nov. 12, 1999, which is a continuation-in-part of application No. 09/135,978, filed on Aug. 18, 1998, now Pat. No. 6,000,185, which is a continuation of application No. 09/090,660, filed on Jun. 4, 1998, now Pat. No. 5,857,303, which is a continuation-in-part of application No. 08/991,868, filed on Dec. 16, 1997, now Pat. No. 5,887,403, which is a continuation of application No. 08/242,716, filed on May 13, 1994, now Pat. No. 5,729,946.

(51) Int. Cl.[7] ..... E04D 1/34

(52) U.S. Cl. ..... 52/105; 52/519; 52/521; 52/523; 52/539; 52/747.1; 52/748.1; 52/520

(58) Field of Search ..... 52/105, 519, 520, 52/521, 523, 539, 543, 747.1, 748.1

(56) References Cited

U.S. PATENT DOCUMENTS

| | | | | |
|---|---|---|---|---|
| 2,961,804 A | | 11/1960 | Beckman | |
| 3,343,325 A | | 9/1967 | Curran | |
| 3,477,184 A | * | 11/1969 | Johnson et al. | |
| 3,738,076 A | | 6/1973 | Kessler | |
| 3,757,483 A | | 9/1973 | Torbett | |
| 3,927,501 A | * | 12/1975 | Allen et al. | 52/105 |
| 4,292,781 A | | 10/1981 | Chalmers et al. | |
| 4,424,655 A | | 1/1984 | Trostle | |
| 4,782,638 A | | 11/1988 | Hovind | |
| 4,947,609 A | | 8/1990 | Champagne | |
| 5,016,416 A | | 5/1991 | Munk | |
| 5,224,318 A | * | 7/1993 | Kemerer | 52/521 |
| 5,392,579 A | | 2/1995 | Champagne | |
| 5,729,946 A | | 3/1998 | Beck | |
| 5,857,303 A | * | 1/1999 | Beck et al. | 52/520 |
| 5,887,403 A | * | 3/1999 | Beck | |
| 6,000,185 A | * | 12/1999 | Beck et al. | 52/520 |
| 2002/0112416 A1 | * | 8/2002 | Beck et al. | 52/105 |

FOREIGN PATENT DOCUMENTS

| | | |
|---|---|---|
| GB | 612570 | 11/1948 |

* cited by examiner

*Primary Examiner*—Robert Canfield
(74) *Attorney, Agent, or Firm*—Paul & Paul

(57) ABSTRACT

Building panels are provided, for applying panels, such as siding, roofing or the like to studs, to roofing rafters, or the like, wherein indicia is provided along a panel, giving spaced-apart markings, for guiding one who is applying panels to a building surface, to the location of a next support capable of supporting the panel when a fastener is applied thereto, a fixed or pre-set distance from a support such as stud, roofing rafter or the like. Thus, when adjacent studs, rafters, or the like, are spaced apart a known distance, the indicia will serve to guide the installer to a location where a fastener will engage a support to which the panel is to be applied, even if the visual location of the underlying support is visually obscured, such as by means of a sheet building material between the structural support and the panel. The indicia may take on various forms.

23 Claims, 2 Drawing Sheets

BUILDING PANEL AS A COVERING FOR BUILDING SURFACES AND METHOD OF APPLYING

This is a continuation of U.S. application Ser. No. 09/438,999 filed Nov. 12, 1999, which in turn is a continuation-in-part of U.S. application Ser. No. 09/135,978 filed Aug. 18, 1998, now U.S. Pat. No. 6,000,185 dated Dec. 14, 1999, which, in turn, is a continuation of application Ser. No. 09/090,660, filed Jun. 4, 1998, now U.S. Pat. No. 5,857,303, which is a continuation-in-part of application Ser. No. 08/991,868, filed Dec. 16, 1997, now U.S. Pat. No. 5,887,403, which is a continuation of application Ser. No. 08/242,716 filed May 13, 1994, now U.S. Pat. No. 5,729, 946.

BACKGROUND OF THE INVENTION

In the art of building construction, it is known to apply panels, such as siding panels or the like, to a wall of a building. Frequently such panels are constructed of vinyl siding, hardboard, aluminum or the like. Examples of such panels and their application to a building exist in U.S. Pat. No. 5,729,946, the complete disclosure of which is herein incorporated by reference.

Similarly, roofing panels may like wise be applied.

Whether applying the panels as siding, onto vertical studs, or as roofing panels onto sloped roof rafters, it is generally commonplace that there is first applied a sheet building material to the supports, whether the supports are wall studs or roof rafters. The siding or roofing panels may then be applied outside the sheet building material.

Often, it is desirable that the siding or roofing panels be secured to these supports by means of fasteners applied through the panels, through the sheet building material, and into the studs or rafters, such that the studs or rafters carry the weight of the panels. In some instances, the sheet building material may exist for reasons other than structural reasons. For example, the sheet building material might be polystyrene foam insulation, fiberglass impregnated material, flakeboard, etc. which may not be as structurally supportive as other materials, such as plywood. In such cases, it is especially desirable that the studs or rafters, rather than the sheet building material, carry the weight of the panel. In other instances, as for example, where the sheet building material is plywood or the like, the sheet building material may not be sufficiently thick that it provides a good secure structure for fastening the panels to it, making it therefore more desirable that the panels be fastened through the sheet building material into the studs or rafters.

Thus, in many such applications of building panels to buildings, the sheet building material that is first applied directly to the studs or rafters visually obscures the precise locations of the studs or rafters behind the sheet building material, in whole or in part.

THE PRESENT INVENTION

The present invention is direct to providing a means for directing the person who is applying fasteners to panels, to the locations of studs or rafters, after the first fastener has been applied through a panel to a stud or rafter, such that successive fasteners applied through a lip of a panel may easily be guided to second, third, fourth, etc. successive studs or rafters. To this end, indicia means is provided along an upper lip of the panel, for guiding the installer from stud-to-stud, or from rafter-to-rafter, based upon known pre-set spacing between adjacent studs or rafters.

For example, in many types of buildings, it is commonplace that vertical studs are located sixteen inches apart. To this end, after a panel has been applied to a first stud, for example, at one end of a house wall, it is simply a matter of using the indicia means that exist on panels of the present invention, to measure sixteen inches farther along that lip, for placement of a second fastener that will find a substantially hidden stud located behind the sheet building material, then another sixteen inches to find the location of a third stud, etc., continuing along the panel until the end thereof. The same can exist when applying panels along a roof to roof rafters or other supports, by applying fasteners through panels, through sheet building material, and into the underlying supports.

The indicia means in accordance with this invention can take various forms, such as graduations, numerical indications such as those of a ruler or the like, alpha-numeric visual indicators, geometric markings, letters, a series of notches, a repeated series of letters, etc. The manner of application can be by ink jet printing, roller marking, roller notching, or any other process that will produce a visible indication.

Accordingly, it is a primary object of this invention to provide building panels with indicia along a lip thereof, to assist in locating fastener zones for driving fasteners through the panels, and into structural supports.

It is a further object of this invention to accomplish the above objects, wherein the panels are applied outside other sheet building material, which, in turn, has been applied to structural members.

It is another object of this invention to accomplish the above objects, wherein the panels may be applied to structural supports such as studs, roof rafters or the like, wherein the studs, roof rafters or other supports are visually obscured by intervening sheet building material.

Other objects and advantages of the present invention will be readily understood by a reading of the following brief descriptions of the drawing figures, detailed descriptions of the preferred embodiments, and the appended claims.

BRIEF DESCRIPTIONS OF THE DRAWINGS FIGURES

DETAILED DESCRIPTIONS OF THE PREFERRED EMBODIMENTS

Figure 1:
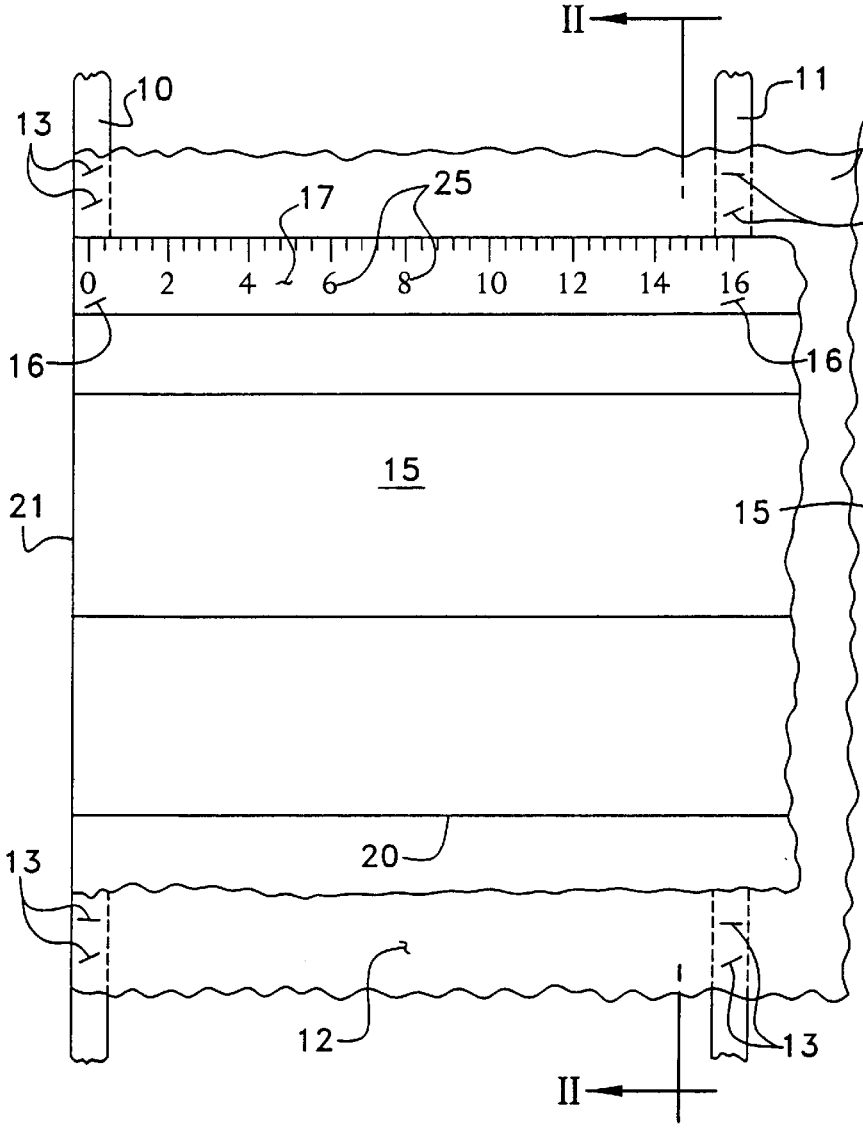
FIG. 1 is a fragmentary front elevational view of a panel applied to a sure of sheet building material that, in turn, has been applied to a stud or other structural support, by means of fasteners.

Referring now to the drawings in detail, reference is first made to FIG. 1, wherein a pair of vertical studs 10, 11 are illustrated in spaced-apart relation. As is frequently commonplace, the studs 10, 11 are spaced apart a horizontal distance of approximately sixteen inches. Applied to the studs, 10, 11, is sheet building material 12, comprised of an insulation material, such as polystyrene foam insulation, flakeboard, a fiberglass panel, or the like, secured by suitable fasteners, such as staples 13, to the studs 10, 11. A panel 15 of vinyl siding or the like is applied by means of suitable staples 16 or other fasteners, which extend through the lip 17 at the upper end of the panel 15, near an upper edge 18 thereof. The panel 15 is constructed generally and similarly to that of the panel of FIGS. 2 and 3 of U.S. Pat. No. 5,729,946 mentioned above, to have a lower edge 20 and left edge 21, as well as a right edge (not shown). The lip 17 of the panel 15 is connected to the remainder of the panel 15 by means of a fusion line, adhesive line, or the like 22, to provide a fastening hem or lip 17, as described.

As in U.S. Pat. No. 5,729,946, the lip is constructed of relatively flexible material comprising a fastener zone means to receive fasteners therethrough and to allow for expansion and contraction of the panel with variations in temperature.

It will be noted that the panel 15 is applied with its lower edge 20 locked beneath a bead 23 of a next subjacent panel 24, in a conventional manner.

In applying the panel 15 over the sheet building material 12, so that it becomes securely fastened to the studs 10, 11, one may first apply a first fastener 16, by means of lining up the panel 15 with the left-most edge of stud 10, applying a nail, staple, or other suitable fastener 16 into the lip 17 of the panel, through the panel 15, and through the sheet building material 12, to securely engage the stud 10 behind the sheet building material.

Thereafter, depending upon the indicia 25, one may measure a pre-set distance, such as 16 inches (assuming the indicia is numerical as shown in FIG. 1), and then apply a further staple 16 or other fastener into the lip 17 of the panel 15, through the sheet building material 12 and into stud 11. Successive applications of staples or other fasteners in this manner can continue, every sixteen inches, assuming that sixteen inches is the pre-establish horizontal spacing between vertical studs 10, 11, or the like. Alternatively, the indicia can be every 8 inches, multiples of 8 inches, every 36 inches, or of any other desired repetitive spacing.

Figure 2:
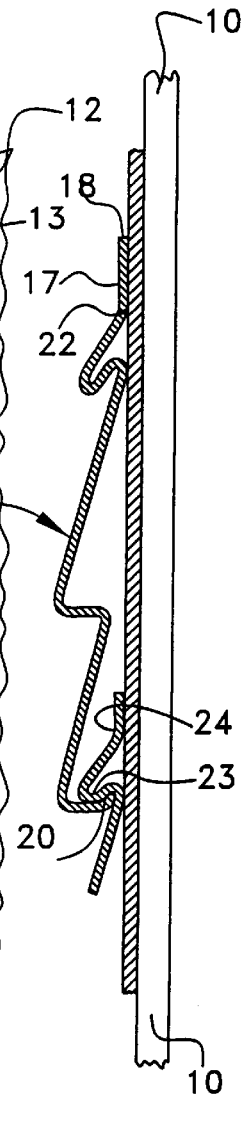
FIG. 2 shows a vertical sectional view, taken through the panel and underlying sheet building material, which in turn, is disposed against and carried by vertical studs or other structural supports, and wherein the panel at its lower end overlies and covers the fastener lip of a next subjacent panel.
Figure 3:
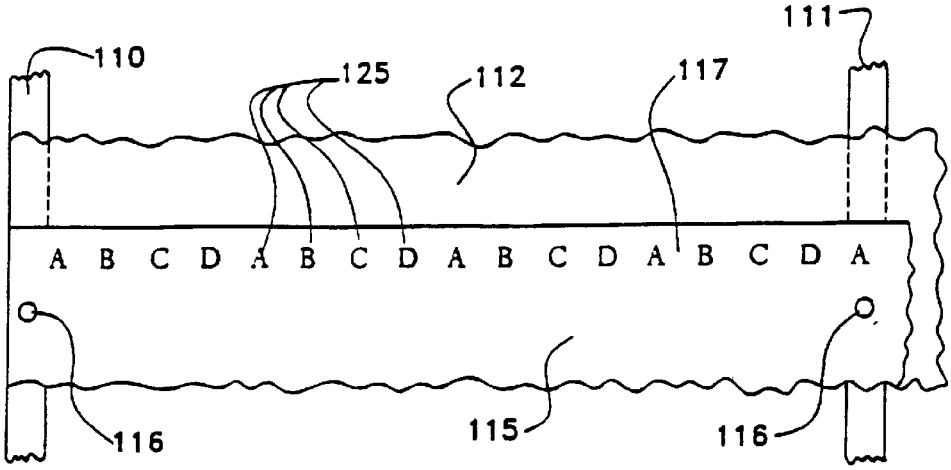
FIG. 3 is a fragmentary vertical elevational view, similar to that of FIG. 1, but wherein the indicia comprise a plurality of letters.

Referring now to FIG. 3, it will be seen that an alternative embodiment is provided in the form of a pair of studs 110, 111 with sheet building material 112, all like those components 10, 11 and 12 respectively of FIGS. 1–2, and wherein a panel 115 having a lip 117 for attachment is provided, and whereby nails and other suitable fasteners 116 may likewise be applied through the lip 117 of the panel 115, through the sheet building material 112, and into the studs 110, 111, being guided thereto by the letters "A", based upon a known formula, such as, for example, that the distance between adjacent studs 110 and 111 will be sixteen inches, and that every four inches the letter "A" will appear. Of course, other prearranged indicia to that "A", "B", "C" and "D", repetitive as shown across the lip 117 of the panel 115, may be employed.

As in U.S. Pat. No. 5,729,946, the lip 117 is constructed of relatively flexible material comprising a fastener zone means to receive fasteners therethrough and to allow for expansion and contraction of the panel with variations in temperature.

Figure 4:
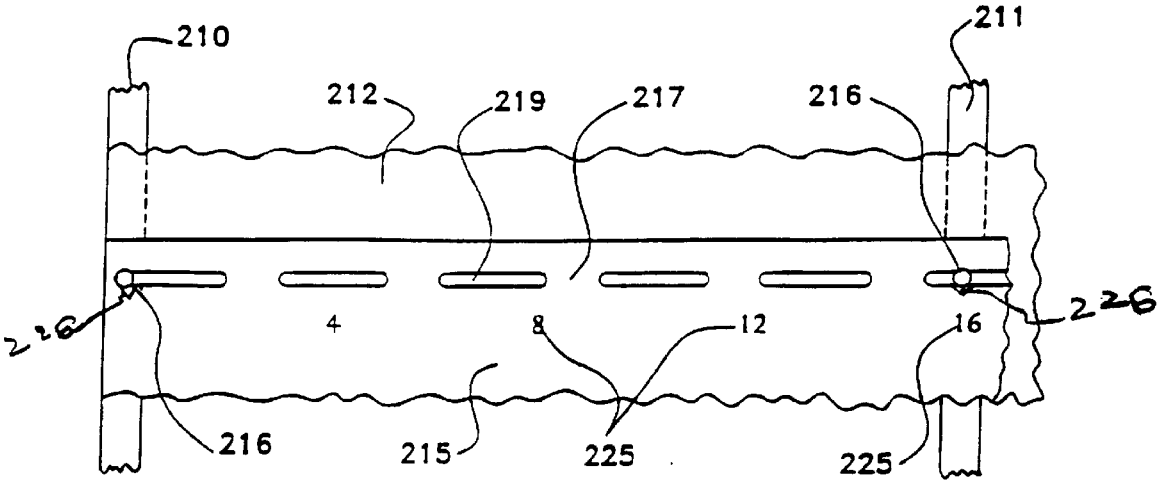
FIG. 4 is a view like that of FIG. 3, but wherein the indicia comprise a plurality of spaced apart numbers, and wherein the lip of the panel is secured through the sheet building material to structural supports, such as studs, by means of fasteners, such as nails, disposed through elongated openings in the lip.

With reference to FIG. 4, yet another panel 215 has fasteners 216 applied through slotted openings 219 in the lip 217 of the panel 215, to pass through sheet building material 212 and into vertical studs 210 and 211 with the placement of the fasteners 216 into the studs 210, 211 being guided by the known distance between the studs (again, sixteen inches, for example) and with the indicia 225 on the lip 217 being spaced apart with markings that will readily enable one to ascertain when one reaches a pre-set distance, such as sixteen inches, for example, away from the originally fastener 216 applied to stud 210 at the left end of FIG. 4, so that one will know when to apply another fastener 216 at a location outside that of another stud 211. The indicia means may comprise distinctively shaped configurations on the panels, such as, for example only, distinctively shaped notches 226 or other shapes, located on the openings 219 or elsewhere on the panel, as desired.

As in U.S. Pat. No. 5,729,946, the openings 219 comprise fastener zone means to receive fasteners therethrough and to allow for expansion and contraction of the panel with variations in temperature.

In accordance with the above invention, it will be apparent that it is possible to nail the siding through the surface material that is masking the location of the stud, directly into the stud. While sometimes installers of siding will take the additional time that is needed to locate the position of a stud, by either using a stud sensor or by measuring from a non-stud location, it will be apparent that both such techniques require some degree of extra time. With the present invention, the tendency that sometimes exists of installers simply guessing as to location of the stud is readily avoided. Also, with the present invention, there exist the capability to improve the speed of installation as well as the accuracy of nailing the siding directly into a stud, in virtually every instance.

It will be apparent from the forgoing that various modifications may be made in the details of construction, as well as in the use and assembling of the panels of this invention, to construct building walls or roofs in accordance with the method of this invention.

What is claimed is:

1. A siding or roofing panel adapted to be applied to a building and secured through a stud-obscuring sheet material to a plurality of visually obscured-from-view spaced apart supports of pre-set, known spacing between supports, comprising:

(a) a sheet of panel having upper and lower edges and right and left edges;

(b) with an upper lip adjacent the upper edge;

(c) with the upper lip including a fastener zone means (i) adapted to receive fasteners therethrough for securing the panel to supports, and (ii) to allow for panel expansion and contraction with variations in temperature and (d) with indicia means in addition to said fastener zone means, integral with and comprising part of the upper lip;

(e) with a plurality of said indicia means being spaced apart along the upper lip an amount corresponding to the known spacing of spaced apart supports for providing a visual indication on the upper lip of the pre-set known spacing between the spaced apart and obscured-from-view supports, for guiding the placement of fasteners through the lip into the supports.

2. The panel of claim 1, wherein the indicia means is adapted to be covered by another panel applied to the supports.

3. The panel of claim 1, wherein the indicia means comprise numerical indicator means.

4. The panel of claim 1, wherein the indicia means comprise indicator means approximately every 16 inches along the lip.

5. The panel of claim 1, wherein the indicia means comprise periodic spaced apart markings corresponding to the spacing of adjacent supports.

6. The panel of claim 1, wherein the indicia means comprise letter markings.

7. The panel of claim 1, wherein the panel is adapted to be applied to the building by being fastened to supports through sheet building material carried by the building, to supports, behind the sheet building material.

8. The panel of claim 1, wherein the fastener zone means comprises a relatively flexible lip, relative to the remainder of the panel, which is relatively rigid.

9. A covering for a building comprising a plurality of siding or roofing panels, each panel being applied to a building and secured through a stud-obscuring sheet material to a plurality of visually obscured-from-view spaced apart supports of pre-set, known spacing between the supports of the building only by fasteners and comprising:

(a) a sheet of panel having upper and lower edges and right and left edges;

(b) with an upper lip adjacent the upper edge;

(c) with the upper lip including a fastener zone means
(i) adapted to receive fasteners therethrough for securing the panel to supports, and
(ii) to allow for panel expansion and contraction with variations in temperature and (d) with indicia means in addition to said fastener zone means, integral with and comprising part of the upper lip;

(e) with a plurality of said indicia means being spaced apart along the upper lip an amount corresponding to the known spacing of spaced apart supports for providing a visual indication on the upper lip of the pre-set known spacing between the spaced apart and obscured-from-view supports, for guiding the placement of fasteners through the lip into the supports.

10. The covering of claim 9, wherein the indicia means of each panel is covered by another panel, also applied to the building by fasteners.

11. The covering of claim 9, wherein the indicia means comprise numerical indicator means.

12. The covering of claim 9, wherein the indicia means comprise indicator means approximately every 16 inches along the lip.

13. The covering of claim 9, wherein the indicia means comprise periodic spaced apart markings corresponding to the spacing of adjacent supports.

14. The covering of claim 9, wherein the indicia means comprise letter markings.

15. The covering of claim 9, wherein each panel is applied to the building by being fastened to supports through sheet building material carried by the building, to supports behind the sheet building material.

16. The covering of claim 9, wherein the indicia means comprise indicator means approximately every 8 inches along the lip.

17. The covering of claim 9, wherein the indicia means comprise indicator means in multiples of approximately every 8 inches along the lip.

18. The covering of claim 9, wherein the indicia means comprise indicator means approximately every 36 inches along the lip.

19. The covering of claim 9, wherein the indicia means comprise distinctively shaped configurations along the panel, as periodic spaced apart markings corresponding to the spacing of adjacent supports.

20. The covering of claim 9, wherein the indicia means comprise distinctively shaped nailing openings appearing as periodic spaced apart markings corresponding to the spacing of the adjacent supports.

21. The covering of claim 9, wherein the fastener zone means comprises a relatively flexible lip, relative to the remainder of the panel, which is relatively rigid.

22. A method of applying siding or roofing panels to a building structure comprising the steps of:

(a) providing a plurality of panels, each having upper and lower edges and right and left edges, with an upper lip adjacent the upper edge; with the upper lip including a fastener zone means adapted to receive fasteners therethrough for securing the panel to supports of pre-set known spacing therebetween, and to allow for panel expansion and contraction with variations in temperature, and with indicia means in addition to said fastener zone means, integral with and comprising part of the upper lip; with a plurality of said indicia means being spaced apart along the upper lip an amount corresponding to the known spacing of spaced apart supports for providing a visual indication on the upper lip of the pre-set known spacing between the spaced apart and obscured-from-view supports;

(b) providing a plurality of spaced apart supports;

(c) providing sheet building material;

(d) securing the sheet building material to the supports;

(e) fastening a first panel at one location to support, by driving one or more fasteners through the lip of the first panel, through the sheet building material; and into supports;

(f) continuing to fasten the first panel through the sheet building material to a plurality of supports, by driving fasteners through the lip of the first panel, through the sheet building material, and into supports;

(g) covering the lip of the first panel, including the fasteners and indicia thereof by applying a second panel over the lip of the first panel and over another portion of sheet building material and fastening the second panel through the sheet building material to supports by driving fasteners through a lip thereof at pre-set, known spacing into the spaced apart supports;

(h) continuing to apply successive panels by driving fasteners through lips thereof, through sheet building material, and into supports of pre-set, known spacing with each successively applied panel covering the lip, including fasteners and indicia means of a next-previously-applied panel.

23. The method of claim 22, wherein the fastener zone means comprises a relatively flexible lip, relative to the remainder of the panel, which is relatively rigid.

* * * * *

UNITED STATES PATENT AND TRADEMARK OFFICE

CERTIFICATE OF CORRECTION

PATENT NO. : 6,715,240 B2
DATED : April 6, 2004
INVENTOR(S) : David H. Beck et al.

It is certified that error appears in the above-identified patent and that said Letters Patent is hereby corrected as shown below:

Column 2,
Line 42, after "applied to a", delete the word "sure" and insert the word -- surface --.

Signed and Sealed this

Twenty-ninth Day of June, 2004

JON W. DUDAS
*Acting Director of the United States Patent and Trademark Office*